US007081573B2

(12) United States Patent
Izen et al.

(10) Patent No.: US 7,081,573 B2
(45) Date of Patent: Jul. 25, 2006

(54) STRING INSTRUMENT WITH PROTECTIVE STRING CAP ASSEMBLIES

(75) Inventors: Mark S. Izen, Chestnut Hill, MA (US); Bernard Chiu, Wellesley, MA (US); Craig Small, Hopkinton, MA (US)

(73) Assignee: First Act Inc., Boston, MA (US)

( * ) Notice: Subject to any disclaimer, the term of this patent is extended or adjusted under 35 U.S.C. 154(b) by 64 days.

(21) Appl. No.: 10/879,252

(22) Filed: Jun. 28, 2004

(65) Prior Publication Data

US 2005/0284280 A1 Dec. 29, 2005

(51) Int. Cl.
*G10D 3/00* (2006.01)

(52) U.S. Cl. ..... 84/290; 84/304

(58) Field of Classification Search ..... 84/290, 84/297 R, 304, 293

See application file for complete search history.

(56) References Cited

U.S. PATENT DOCUMENTS 5,627,331 A * 5/1997 Devitrysmith ..... 84/304
6,353,165 B1 3/2002 Chiu et al. ..... 84/304

* cited by examiner

*Primary Examiner*—Marlon T. Fletcher
*Assistant Examiner*—Jianchun Qin
(74) *Attorney, Agent, or Firm*—John E. Toupal; Harold G. Jarcho

(57) ABSTRACT

A string instrument including a body; a headstock; a neck extending between the body and the headstock; a plurality of tuning mechanisms retained by the headstock and each having a stem with a tuning end and a connection end; and a plurality of connectors each connecting a different pair of covers. Also included are a plurality of strings each having one end connected to the body and an opposite end connected to a different connection end; and a cover covering each connection end and shaped and arranged to prevent physical access to the opposite end connected thereto.

18 Claims, 4 Drawing Sheets

STRING INSTRUMENT WITH PROTECTIVE STRING CAP ASSEMBLIES

BACKGROUND OF THE INVENTION

String instruments such as acoustic and electric guitars are widely used both for personal enjoyment and entertainment. Although string instruments generally are a source of enjoyment, the strings employed to produce musical sound occasionally can be troublesome. Ends of the strings are attached to tuning stems which can be rotated to adjust string tension and affect pitch of the instrument. The sharp free ends of the strings are exposed and, therefore, can inflict personal injury when contacted by users of the instrument. In addition, the free ends are somewhat unattractive and thereby degrade the overall appearance of the instrument.

Disclosed in U.S. Pat. No. 6,353,165 B1 is a guitar having cover devices which are attached to the guitars tuning mechanisms. The covers enhance the appearance of the guitar and prevent undesirable physical contact with exposed ends of the instrument's strings. However, the cover devices consist of base portions secured to the instrument and hinged cap portions which can be opened to provide access to the strings. During use of the instrument, the cap portions can sometimes be severed from the base portions and then misplaced or lost.

The object of this invention, therefore, is to provide an improved cover for the tuning mechanisms of string instruments.

SUMMARY OF THE INVENTION

The invention is a string instrument including a body; a headstock; a neck extending between the body and the headstock; and a plurality of tuning mechanisms retained by the headstock and each having a stem with a tuning end and a connection end. Also included are a plurality of strings each having one end connected to the body and an opposite end connected to a different connection end; and a cover covering each connection end and shaped and arranged to prevent physical access to the opposite end connected thereto, and a connector joining each pair of covers. The cover prevents inadvertent personal injury by the covered opposite ends of the strings, and the connectors reduce the occurrence of separated, individual covers being misplaced or lost.

According to one feature of the invention, the cover includes a base portion secured to the headstock, and a cap portion movable relative to the base portion between a closed position covering the connection end and an open position providing access to the connection end. The provision of relatively movable cap and base portions permit access to the connection ends of the strings without demounting of the covers from the headstock.

According to another feature of the invention, at least two connectors join the covers on at least three tuning mechanisms mounted along opposite ends of the headstock.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
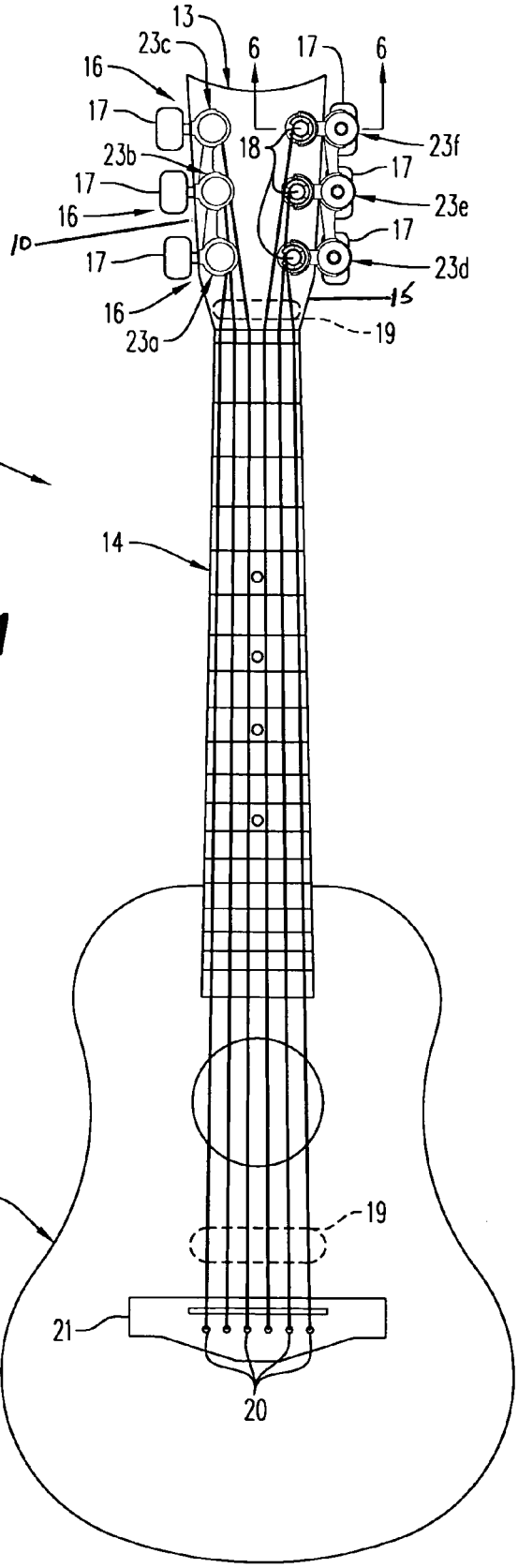
FIG. 1 is a plan view of a string instrument according to the invention.
Figure 4:
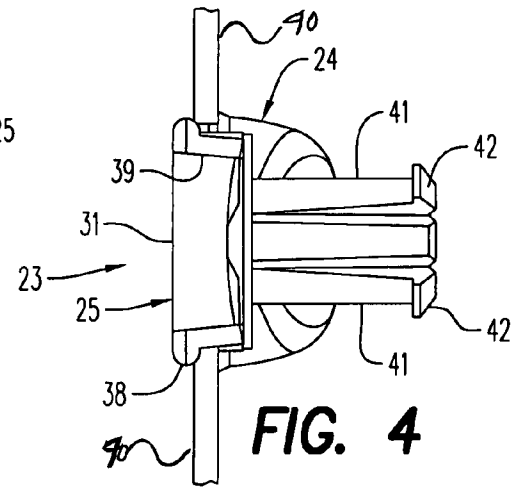
FIG. 4 is a right side view of the cover shown in FIG. 2.
Figure 2:
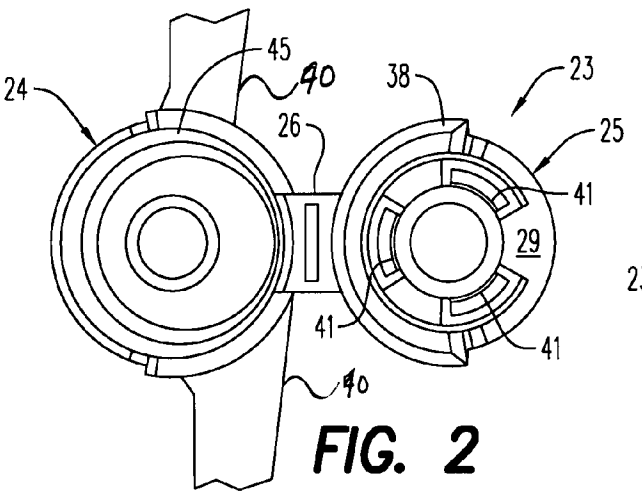
FIG. 2 is a plan view of a string cover used with the instrument of FIG. 1 and shown in an open position.
Figure 3:
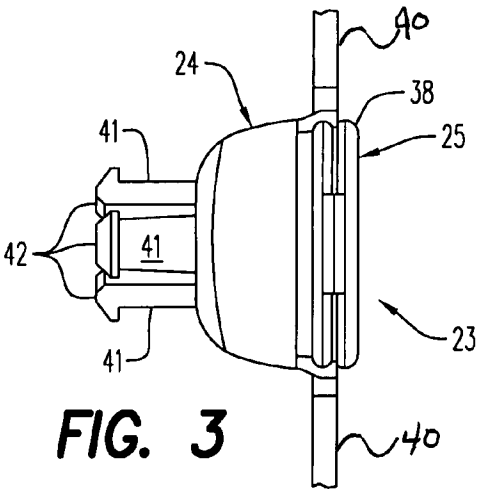
FIG. 3 is a left side view of the cover shown in FIG. 2.
Figure 5:
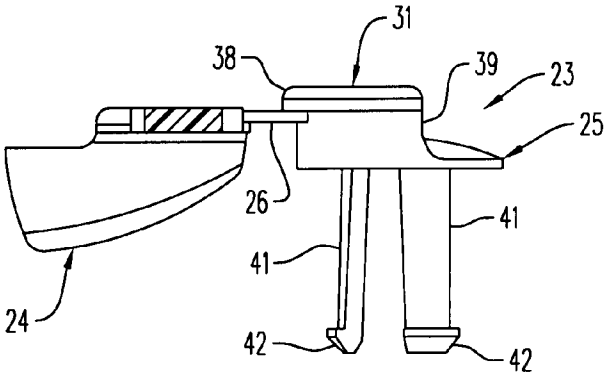
FIG. 5 is a rear view of the cover shown in FIG. 2.

A string guitar instrument 11 according to the invention is illustrated in FIG. 1. Included in the guitar 11 is a body 12 and a headstock 13 joined by a neck 14. A plurality of conventional tuning mechanisms 16 are mounted in the headstock 13. The tuning mechanisms include a first set of three mounted along one edge 10 of the headstock 13 and a second set of three mounted along another edge 15 opposite to the one edge 10. Each tuning mechanism includes a tuning knob 17 and a tuning stem 18 projecting through the headstock 13. A conventional tuning gear assembly (not shown) is operably coupled between each knob 17 and each stem 18. Extending between the body 12 and the headstock 13 are a plurality of strings 19 each having one end 20 connected to a support 21 on the body 12 and an opposite end connected to a different one of the tuning stems 18. Also included with the guitar 11 are a plurality of accessory covers 23*a*–23*f*, each mounted on the headstock 13. The covers 23*a*–23*c* at the one edge 10 of the headstock 13 are shown in a closed position and the covers 23*d*–23*f* at the another edge 15 of the headstock 13 are shown in an open position.

Figure 6:
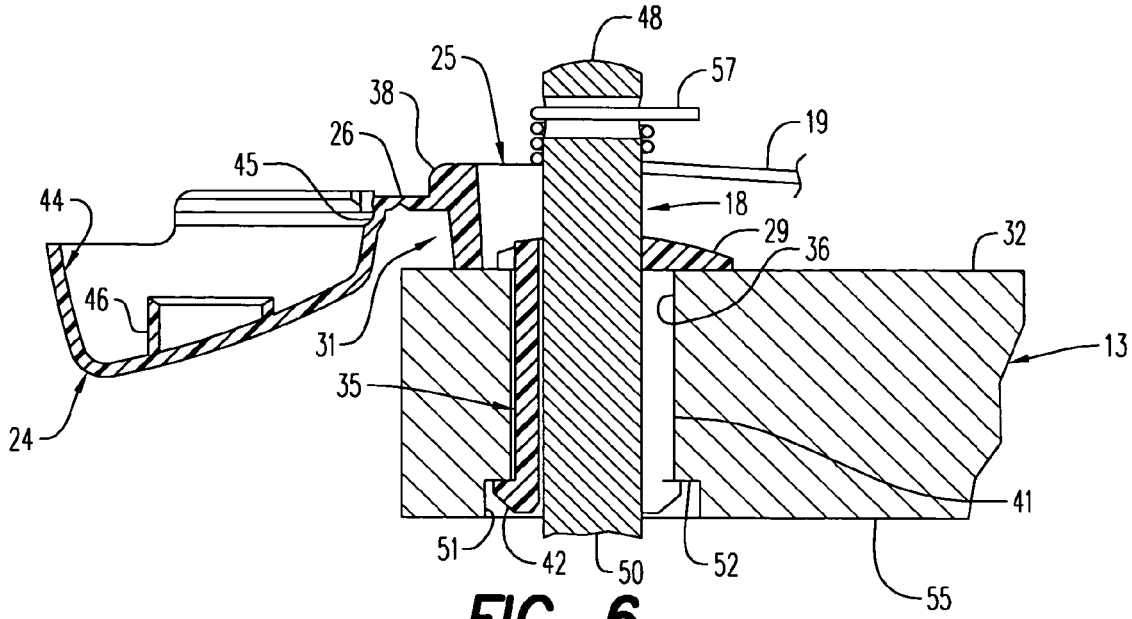
FIG. 6 is a sectional view taken along lines 6—6 of FIG. 1.
Figure 7:
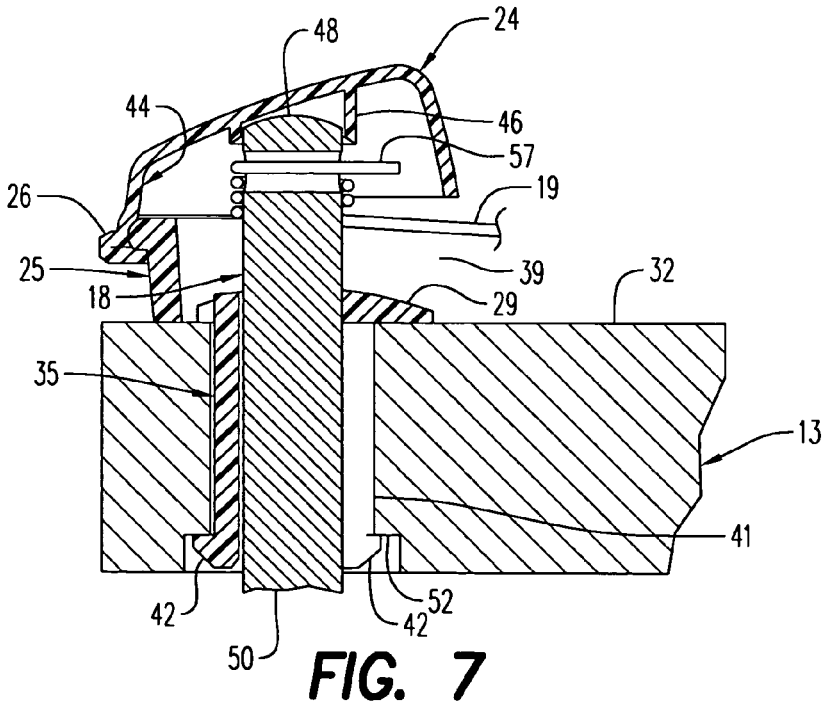
FIG. 7 is a cross-sectional view similar to that shown in FIG. 6 but with the cover shown in a closed position.
Figure 8:
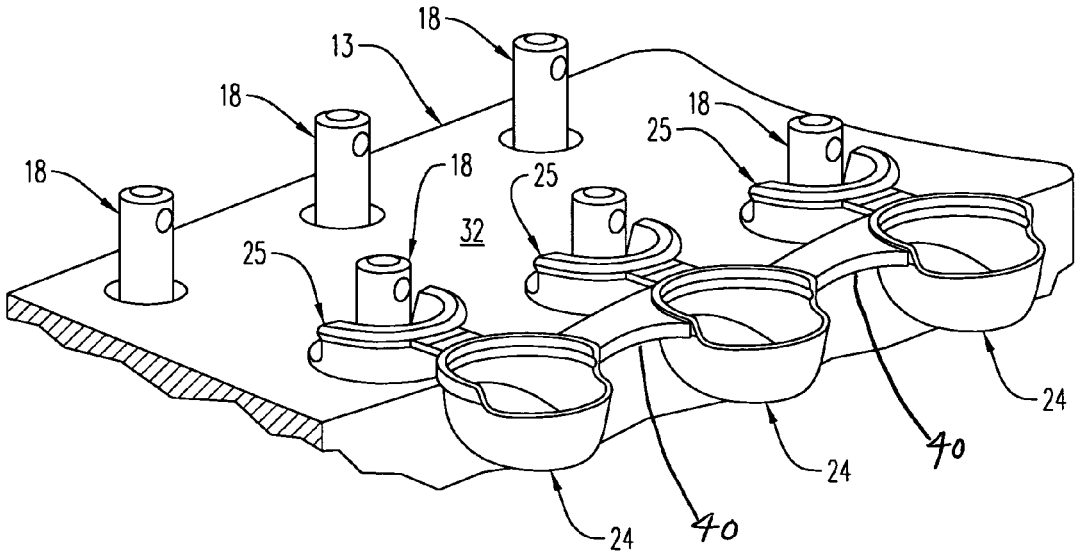
FIG. 8 is a partial perspective view of a headstock of the instrument of FIG. 1 and showing three tuning stems without covers and three tuning stems provided with covers in an open position.
Figure 9:
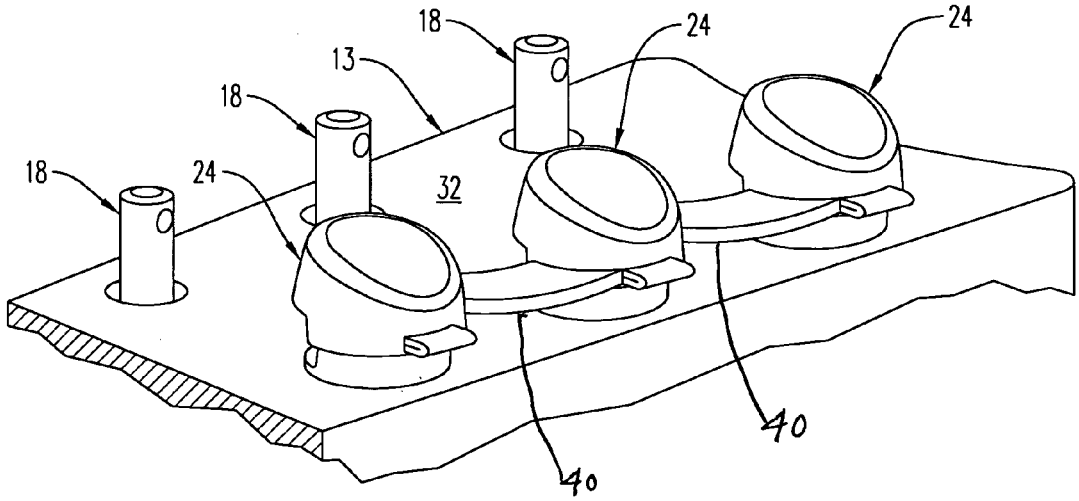
FIG. 9 is a perspective view similar to that shown in FIG. 8 but with the string covers depicted in closed positions.

Each cover 23 includes a cap portion 24 and a base portion 25 joined by a living hinge portion 26 as illustrated in FIGS. 2–7. The base portion 25 consists of a semi-cylindrical portion 31, an annular central portion 29 for mounting on a top surface 32 of the headstock 13, and an annular fastener portion 35 extending below the central portion 29 and received by a hole 36 in the headstock 13 (FIGS. 6 and 7). Defined by the semi-cylindrical portion 31 is an upwardly projecting bead forming an arcuate contact surface 38 and an opening 39 projecting transversely therefrom. The fastener portion 35 includes three flexible legs 41 having upper ends connected to the semi-cylindrical portion 31 and bottom ends defining outwardly projecting locking tabs 42. Connecting each pair of the covers 23*a*–23*f* is a connector 40 extending between cap portions 24 of each pair of covers.

The cap portion 24 is in the form of a cup 44 with an upper rim defining an arcuate engagement surface 45 shaped to fittedly engage the arcuate contact surface 38 on the semi-cylindrical portion 31. Also defined by the cup shaped cap portion 24 is an inwardly projecting cylindrical portion 46 shaped to fittedly engage a connection end 48 of the tuning stem 18 as shown in FIG. 7.

During assembly of the guitar 11, the connector joined cover assemblies 23*a*–23*c* and 23*d*–23*f* respectively, are mounted on the tuning mechanism along the edges 10 and 15 of the headstock. The fastener portions 35 of the covers 23 are inserted into the holes 36 in the headstock 13 as shown in FIG. 6. During insertion, the flexible legs 41 are flexed inwardly until the locking tabs 42 reach a counterbore 51 in the hole 36. At that point, the locking tabs 42 spring outwardly and engage a shoulder surface 52 formed by the counterbore 51 and thereby secure the cover 23 in position on the headstock 13. Next, the tuning mechanisms 16 are installed by inserting a tuning stem 18 upwardly through each annular fastener portion 35. A conventional gear assembly (not shown) coupled to a tuning end 50 of the tuning stem 18 then is fixed to a lower surface 55 of the headstock 13 by conventional means (not shown).

Prior to use of the guitar 11, opposite ends 57 of each string 19 is wound around a stem 18 and inserted through an aperture 58 in a connection end 48 of the stem 18 with its cap 24 in the open position depicted in FIG. 6. The tuning knobs 27 then are actuated to produce rotation of the stems 18 and tightly wind the opposite ends 57 of the strings 19 around the connection ends 48. After securement of each opposite end 57, the associated cap portion 24 of the associated cover 23 is pivoted into the closed position shown in FIG. 7. The cap portion 24 is retained in the closed position by the frictional engagement between the arcuate contact and engagement surfaces 38, 45 and between the cylindrical portion 46 and connection end 48 of the stem 18. Closure of the cap portion 24 is facilitated by the opening 39 in the base portion 25 which allows passage of the string 19. However, the closed cap portion 24 prevents physical access to the free opposite end 57 of the string 19. Subsequent fine tuning of the guitar 11 by rotation of the tuning knobs 17 is not hindered by the closed cover 23.

Obviously, many modifications and variations of the present invention are possible in light of the above teachings. It is to be understood, therefore, that the invention can be practiced otherwise than as specifically described.

What is claimed is:

1. A string instrument comprising:

a body;

a headstock;

a neck extending between said body and said headstock;

a plurality of tuning mechanisms retained by said headstock, each said tuning mechanism comprising a stem having a tuning end and a connection end;

a plurality of strings each having one end connected to said body and an opposite end connected to a different said connection end;

a plurality of cover means, each cover means covering a different said connection end and shaped and arranged to prevent physical access to said opposite end connected thereto; and a plurality of connectors each connecting a different pair of said cover means.

2. A string instrument according to claim 1 wherein each said cover means comprises a base portion secured to said headstock, and a cap portion movable relative to said base portion between a closed position covering said connection end and an open position providing access to said connection end.

3. A string instrument according to claim 2 wherein each said connector connects a different pair of said cap portions.

4. A string instrument according to claim 1 wherein said plurality of tuning mechanisms comprise a first set thereof spaced apart along one edge of said headstock, a second set thereof spaced apart along another edge of said headstock, and all of said cover means covering said connection ends of each of said first and second sets are connected together by said connectors.

5. A string instrument according to claim 4 wherein each of said first and second sets comprise at least three tuning mechanisms having cover means joined by at least two said connectors.

6. A string instrument according to claim 4 wherein each said cover means comprises a base portion secured to said headstock, and a cap portion movable relative to said base portion between a closed position covering said connection end and an open position providing access to said connection end.

7. A string instrument according to claim 6 wherein each said connector connects a different pair of said cap portions.

8. A string instrument according to claim 7 wherein each of said first and second sets comprise at least three tuning mechanisms having cap portions joined by at least two said connectors.

9. An accessory for a string instrument having a body; a headstock; a neck extending between the body and the headstock; a plurality of tuning mechanisms retained by the headstock and each having a stem with a tuning end and a connection end, and, a string having one end connected to the body and an opposite end connected to each connection end; said accessory comprising:

a plurality of cover means each for covering a different one of the connection ends and being shaped and arranged to prevent physical access to the opposite end of the string connected thereto; each said cover means comprising a base portion secured to said headstock, and a cap portion movable relative to said base portion between a closed position covering the connection end and an open position providing access to the connection end; and wherein with said cap portion in said closed position said cover means defines an opening for allowing passage of the string; and a plurality of connectors each connecting a different pair of said cover means.

10. A string instrument according to claim 9 wherein each said connector connects a different pair of said cap portions.

11. A string instrument according to claim 9 wherein said plurality of tuning mechanisms comprise a first set thereof spaced apart along one edge of said headstock, a second set thereof spaced apart along another edge of said headstock, and all of said cover means covering said connection ends of each of said first and second sets are connected together by said connectors.

12. A string instrument according to claim 11 wherein each said connector connects a different pair of said cap portions.

13. A string instrument according to claim 12 wherein each of said first and second sets comprise at least three tuning mechanisms having cap portions joined by at least two said connectors.

14. A string instrument comprising:

a body;

a headstock;

a neck extending between said body and said headstock;

a plurality of tuning mechanisms retained by said headstock, each said tuning mechanism comprising a stem having a tuning end and a connection end;

a plurality of strings each having one end connected to said body and an opposite end connected to a different said connection end;

cover means covering each said connection end and shaped and arranged to prevent physical access to said opposite end connected thereto; said cover means comprising a base portion secured to said headstock, a cap portion movable relative to said base portion between a closed position covering said connection end and an open position providing access to said connection end, and a hinge portion connecting said cap portion to said base portion; and wherein with said cap portion in said closed position said cover means defines an opening providing passage for said string; and a plurality of connectors each connecting a different pair of said cover means.

15. A string instrument according to claim 14 wherein each said connector connects a different pair of said cap portions.

16. A string instrument according to claim 14 wherein said plurality of tuning mechanisms comprise a first set thereof spaced apart along one edge of said headstock, a second set thereof spaced apart along another edge of said headstock, and all of said cover means covering said connection ends of each of said first and second sets are connected together by said connectors.

17. A string instrument according to claim 16 wherein each said connector connects a different pair of said cap portions.

18. A string instrument according to claim 17 wherein each of said first and second sets comprise at least three tuning mechanisms having cap portions joined by at least two said connectors.

* * * * *